US006322944B1

(12) United States Patent
Kim et al.

(10) Patent No.: US 6,322,944 B1
(45) Date of Patent: Nov. 27, 2001

(54) INK FOR LIQUID ELECTROPHOTOGRAPHIC COLOR PRINTING SYSTEM

(75) Inventors: Yu-man Kim, Seongnam; In-yong Song, Suwon; Yong-kook Kim; Seung-young Byeon, both of Seongnam, all of (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/659,568

(22) Filed: Sep. 11, 2000

(30) Foreign Application Priority Data

Sep. 10, 1999 (KR) ..... 99-38700

(51) Int. Cl.[7] ..... G03G 9/12; G03G 9/09
(52) U.S. Cl. ..... 430/114; 430/115; 430/45
(58) Field of Search ..... 430/42, 45, 106, 430/114, 115, 117

(56) References Cited

U.S. PATENT DOCUMENTS 5,607,808 * 3/1997 Nishizawa et al. ..... 430/137
5,652,282 * 7/1997 Baker et al. ..... 430/116
5,916,718 * 6/1999 Kellie et al. ..... 430/45

OTHER PUBLICATIONS

American Chemical Society (ACS) File Registry No. 30125–47–4, describing C.I. Pigment Yellow 138, Copyright 2001.*

* cited by examiner

*Primary Examiner*—Janis L. Dote
(74) *Attorney, Agent, or Firm*—Robert E. Bushnell, Esq.

(57) ABSTRACT

An ink for a liquid electrophotographic color printing system is optimized to reduce the lowering of image density due to wash-off, to obtain a stable over-toned color, and to have a wide reproducible color gamut. The ink includes a plurality of toners for yellow (Y), magenta (M) and cyan (C), each toner being provided in a respective one of a plurality of developing devices, and each toner having a pigment (p) for forming an image having a predetermined color, a binder (b) for binding the pigment on printing paper, a charge controller for imparting electrical properties on the toners, and a stabilizer. A carrier transfers the toners from the developing devices to a photoreceptor belt during development. The blending ratio (b/p) of the binder (b) to the pigment (p) of each toner for yellow (Y), magenta (M) and cyan (C) satisfies the following expressions:

$$b/p_{yellow(Y)}=5\pm1;$$

$$b/p_{magenta(M)}=7\pm1;$$

and $$b/p_{cyan(C)}=8\pm1.$$

27 Claims, 6 Drawing Sheets

INK FOR LIQUID ELECTROPHOTOGRAPHIC COLOR PRINTING SYSTEM

CLAIM OF PRIORITY

This application makes reference to, incorporates the same herein, and claims all benefits accruing under 35 U.S.C. §119 from my application INK FOR LIQUID ELECTROPHOTOGRAPHIC COLOR PRINTING SYSTEM filed with the Korean Industrial Property Office on Sep. 10, 1999 and there duly assigned Serial No. 38700/1999.

BACKGROUND OF THE INVENTION

1. Field of the Invention

The present invention relates to ink for a liquid electrophotographic color printing system which can print a color image in a single pass manner and, more particularly, to ink for a liquid electrophotographic color printing system which is optimized to reduce the lowering of image density due to wash-off, to obtain a stable over-toned color, and to have a wide reproducible color gamut.

2. Description of the Related Art

In general, a liquid electrophotographic color printing system forms an electrostatic latent image by irradiating laser beams on a photosensitive medium, develops the image using developing devices, and transfers and prints the developed image to a sheet of printing paper through a transfer unit.

Such ink for a liquid electrophotographic color printing system is subject to various drawbacks or disadvantages. The latter include a "washing off" phenomenon and a decrease in the "development vector". The latter terms (contained in quotation marks) are defined below.

Thus, there is a need in the art to develop an ink for liquid electromagnetic printing which does not suffer from the above disadvantages.

SUMMARY OF THE INVENTION

To solve the above problems, it is an objective of the present invention to provide ink for a liquid electrophotographic color printing system operating in a single pass manner, the ink being selected such that an image change due to wash-off and the development vector falls within the range of tolerable error.

Accordingly, to achieve the above objective, there is provided an ink for a liquid electrophotographic color printing system including a plurality of toners for yellow (Y), magenta (M) and cyan (C). Each toner is provided in a respective one of a plurality of developing devices, and each has a pigment (p) for forming an image having a predetermined color, a binder (b) for binding the pigment on printing paper, a charge controller for imparting electrical properties to the toner, a stabilizer, and a carrier for transferring the toner from the development device to the photoreceptor belt during development. The blending ratio (b/p) of the binder (p) to the pigment (p) of each toner for yellow (Y), magenta (M) and cyan (C) satisfies the following expressions:

$$b/p_{yellow(Y)}=5\pm1;$$

$$b/p_{magenta(M)}=7\pm1;$$

and $$b/p_{cyan(C)}=8\pm1.$$

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
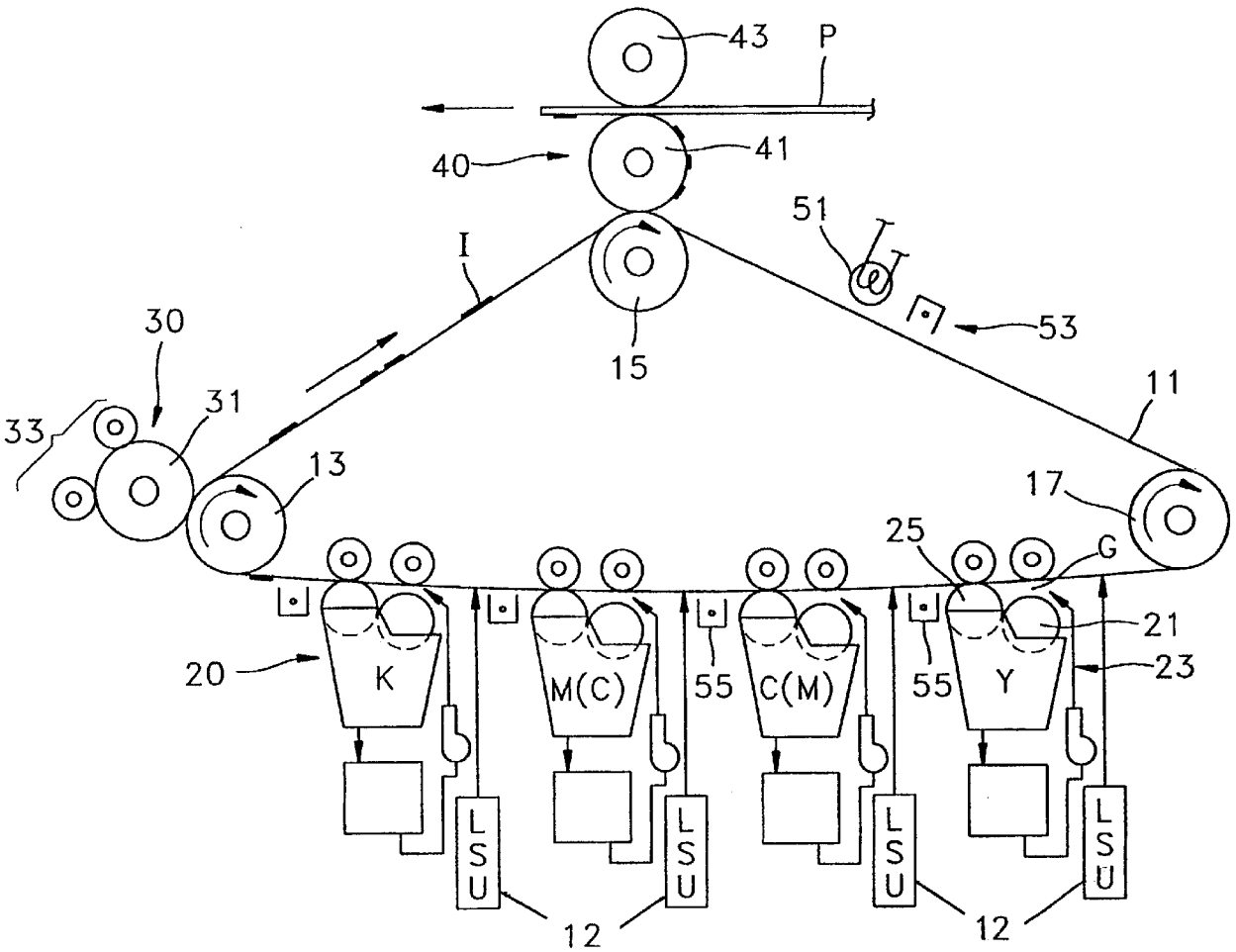
FIG. 1 is a schematic diagram illustrating a liquid electrophotographic color printing system.

FIG. 1 is a schematic diagram illustrating a liquid electrophotographic color printing system.

Referring to FIG. 1, a liquid electrophotographic color printer includes a photoreceptor belt 11 traveling along a predetermined path, a plurality of laser scanning units (LSUs) 12 for forming electrostatic latent images corresponding to different colors, (that is, yellow (Y), cyan (C), magenta (M) and black (K)) by irradiating laser beams onto the photoreceptor belt 11, a plurality of developing units 20 for developing the image corresponding to the electrostatic latent images of the respective colors on the photoreceptor belt 11, a drying unit 30 for drying carrier adhered to the photoreceptor belt 11, and a transfer unit 40 for transferring the image (I) transferred through the photoreceptor belt 11 to printing paper (P).

The photoreceptor belt 11 is wound around a driving roller 13, a transfer backup roller 15 and a steering roller 17, and travels along a predetermined track. A color image formed using the photoreceptor belt 11 is transferred to the printing paper P through development of the respective colors and a transfer process while the photoreceptor belt 11 rotates once. In the vicinity of the photoreceptor belt 11, there are installed an erasing lamp 51 for erasing charges remaining on the photoreceptor belt 11 by irradiating light, a main charging device 53 for electrifying the charges on the photoreceptor belt 11 to a predetermined level after erasing charges, and a plurality of topping charging devices 55 for increasing the electric potential on the surface of the photoreceptor belt 11, which was lowered after development of the respective colors.

The respective developing units 20 are arranged so as to be capable of developing different colors in the order of Y, C, M and K or in the order of Y, M, C and K. Each of the developing units 20 includes a development roller 21 having a predetermined development voltage and spaced apart by a development gap G to face the photoreceptor belt 11, a sprayer 23 for supplying ink I to the development gap G, and a squeegee roller 25 pressed against the photoreceptor belt 11 to form a film of the image developed on the photoreceptor belt 11. The ink I contains toner transferred to the printing paper P to form a color image, and liquid carrier for transferring the toner to a region where the electrostatic latent image of the photoreceptor belt 11 is formed during development.

The drying unit 30 includes a drying roller 31 for absorbing carrier while in contact with an image forming surface of the photoreceptor belt 11, and regeneration rollers 33 for heating the surface of the drying roller 31 to evaporate the absorbed carrier. If even a part of the image developed on the photoreceptor belt 11 is peeled off by the drying roller 31, the quality of the image is lowered.

The transfer unit 40 includes a transfer roller 41 which is positioned to face the transfer backup roller 15 with the photoreceptor belt 11 disposed therebetween, and to which the image developed on the photoreceptor belt 11 is transferred, and a fusing roller 43 positioned to face the transfer roller 41 with the printing paper P disposed therebetween for pressing the printing paper P. The image I transferred to the transfer roller 41 is transferred to the printing paper P fed between the transfer roller 41 and the fusing roller 43.

The liquid electrophotographic printer having the aforementioned configuration has an advantage in that it can perform printing fast since the printing process is completed during one rotation cycle of the photoreceptor belt 11. Also, compared to the toner used in a dry electrophotographic color printer, the toner particles used in the liquid electrophotographic printer are small, thereby attaining an image of high resolution.

However, since the image developed by a developing unit passes a next developing unit before being transferred onto printing paper, the toner developed onto the photoreceptor belt may be washed off and a development vector may be reduced.

The term "washing-off" refers to a phenomenon in which toner developed on a photoreceptor belt by a developing unit is washed off due to a potential difference between the development roller and the photoreceptor belt. The term "development vector" refers to a difference between a development voltage and a voltage applied to the photoreceptor belt. A decrease in the development vector occurs when an exposure charge potential of a developed portion of the photoreceptor belt is not sufficiently lowered by an electrical property of the toner developed on the photoreceptor belt when a next color is overlapping-printed over predetermined toner which has been previously developed on the photoreceptor belt, resulting in a decrease in the development amount.

The present invention generally concerns ink selected to be adapted for a liquid electrophotographic color printer having the configuration shown in FIG. 1, and the procedure of selecting the ink will now be described. In detail, the general properties of ink, a wash-off measuring method, a method for measuring a decrease in development vector, and the selection of ink and pigment having an optimal blending ratio of binder to pigment will be described.

Ink for use in a liquid electrophotographic printing system is an electrical insulator and is such that charged toner particles are dispersed in carrier liquid. Here, the carrier is oil liquid such as NORPAR or ISOPAR, and serves to carry the toner to a photoreceptor belt 11 (FIG. 1) during development. The toner is a material transferred to printing paper P ( FIG. 1) after printing to form an image, and consists of a pigment, a polymer binder for binding the pigment on the printing paper, a charge controller for imparting an electrical property on the toner, and a stabilizers. NORPAR and ISOPAR are registered trademarks owned by Exxon Corporation of New York, N.Y., and are used to designate hydrocarbon solvents such as branched paraffinic solvent blend and aliphatic hydrocarbon solvent blend, respectively.

The amount of the toner charged is determined by the amount of the charge controller injected. Generally, the more charge controller injected, the more toner particles are charged, thereby increasing the electrical conductivity of ink. The ink supplied during the development of each color is a mixed liquid of toner and carrier having a solid content of about 2 to 4%.

In the ink, it is the pigment for toner particles that is pertinent to coloring. Thus, the characteristics of image density, depending on the development amount of the ink, are determined by the blending ratio of pigment and binder.

Figure 2:
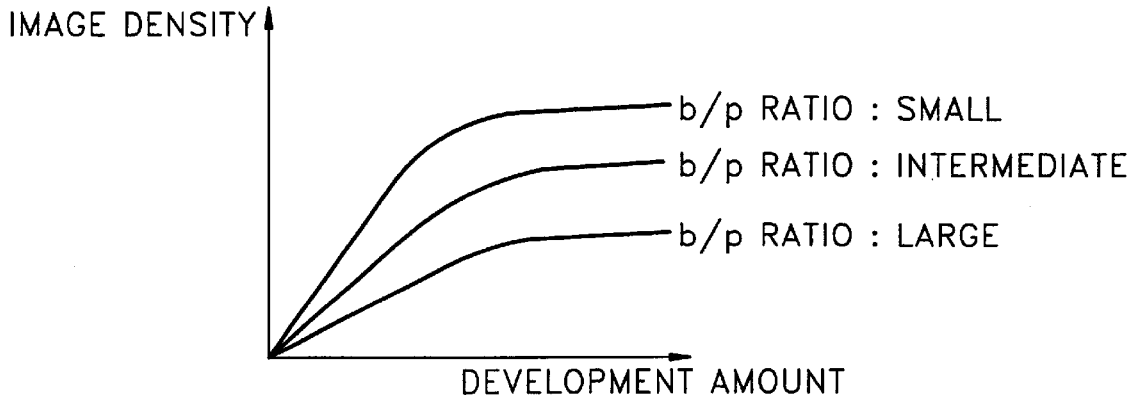
FIG. 2 is a graph illustrating the relationship between the image density and the development amount depending on the ratio of a binder to a pigment.

FIG. 2 is a graph illustrating the relationship between the image density and the development amount depending on the ratio of binder to pigment (referred to as a "b/p ratio"). Referring to FIG. 2, if the b/p ratio is larger (that is, the amount of the pigment per each unit weight of the toner is smaller), a large amount of toner is required to obtain a predetermined image density, and vice versa.

The wash-off of the toner developed by a neighboring developing unit is measured by a difference in the development amount per unit area of a photosensitive medium, the difference being measured by a taping-off method under development conditions 1 and 2 to be described below.

In the latter regard, development condition 1 refers to a condition for one-color printing, in which only a development device by which the development amount is to be measured is maintained at a state for development, and the other development devices are spaced apart from a photoreceptor belt. Development condition 2 refers to a condition in which all development devices are maintained at a state for development, and a corresponding development device performs one-color printing. A development device being spaced apart from a photoreceptor belt implies that a gap between the development roller of the development device and the photoreceptor belt is greater than a development gap G ( FIG. 1), and a squeegee roller is spaced apart from the photoreceptor belt.

Table 1 shows ink pigments of a comparative example.

TABLE 1

| Ink | Color index | Remarks |
|---|---|---|
| Y | PY138<br>PY83 | Produced by blending PY138 and PY83 in a ratio of 7:3. (PY138 is a green-shade organic matter and PY83 is a red-shade organic matter.) |
| M | PR81:3 | Organometalic matter |
| C | PB15:4 | Organometalic matter |

When the ink pigment is selected as shown in Table 1, wash-off was measured two times by a taping-off method with respect to toner developed on a photoreceptor belt, and the measurement results are shown in Table 2.

TABLE 2

| Ink set | Yellow (Y) [$\mu$g/cm$^2$] | Cyan (C) [$\mu$g/cm$^2$] | Magenta (M) [$\mu$g/cm$^2$] | Black (K) [$\mu$g/cm$^2$] |
|---|---|---|---|---|
| 1 | 30 | 10 | 26 | 25 |
| 2 | 22 | 40 | 34 | 16 |

It is understood from the above results that the amount of wash-off ranges from 20 to 40 $\mu$g/cm$^2$, even though there is a slight difference depending on color. When an appropriate development amount is about 200 $\mu$g/cm$^2$, the wash-off is about 20% of the development amount, as indicated by the results shown in Table 2, and this is not a negligible amount.

The development vector is a driving force of electrical force which allows charged ink to move toward the photoreceptor belt. If the development vector increases, the development amount increases accordingly.

A reduced amount of the development vector can be obtained by exposing the developed portion of the photoreceptor belt, and measuring a change in the exposure potential due to the developed toner.

Table 3 shows the result of measuring reduced amounts of development vector two times.

TABLE 3

| Ink set | Yellow (Y) [Volts] | Cyan (C) [Volts] | Magenta (M) [Volts] |
|---|---|---|---|
| 1 | 80 | 80 | 90 |
| 2 | 40 | 50 | 90 |

Reduction in the development amount is mainly caused by the electrical properties of the developed toner (that is, dielectric features). As shown in Table 3, the reduction in the development vector of the developed toner is about 80 Volts, which corresponds to the reduction in the development amount of about 40 $\mu$g/cm$^2$, which is not a negligible amount, like the wash-off.

The problem of the wash-off can be partially solved by improving the structure of a squeegee roller but cannot be completely solved. Also, the problem of the reduced development vector cannot be completely solved due to properties of ink. Thus, reduction in the development amount of maximum 80 $\mu$g/cm$^2$ cannot be avoided.

Figure 3:
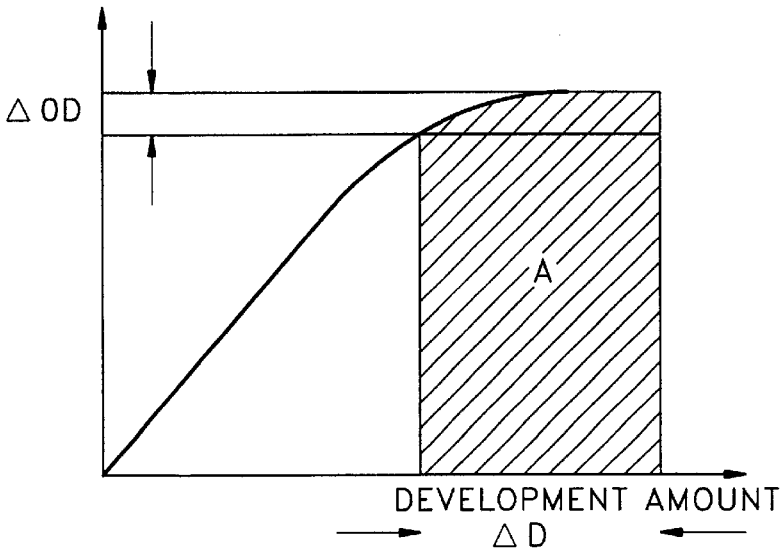
FIG. 3 is a graph illustrating the relationship between the variation range of development amount and image density.

If the development amount is reduced due to the wash-off or reduced development vector, in order to minimize a change in the color to be expressed by a printing system, even if a variation ($\Delta$D) in the development amount is large, it is necessary to optimize ink such that an image density falls within the range A which does not exceed an allowable range of a target image density ($\Delta$OD), as shown in FIG. 3.

In selecting ink having an optimal b/p ratio, it is important to make a small change in the image density depending on a change in the development amount. To this end, it is necessary to observe a change in the image density-versus-development amount curve while varying the b/p ratio by each colored ink, and to find out a b/p ratio corresponding to a curve having a changing trend similar to that shown in FIG. 3.

The range of an appropriate development amount will now be described. If the development amount falls short of the appropriate range, a target image density cannot be attained, and the image cannot completely be transferred to a transfer roller. As a result, some of the image remains on the photoreceptor belt, which adversely affects the next image, thereby lowering printing quality. Also, the image transferred to the transfer roller cannot completely be transferred to printing paper, thereby further lowering the printing quality. By contrast, if the development amount exceeds the appropriate range, the amount of the development vector is reduced by the previously developed toner, which makes it impossible to sufficiently develop a next color to be developed. Thus, when an over-toned image is desired, over-toned colors (such as red, green or blue), which are attained by over-toning of Y, C or M, cannot be obtained. Also, the appropriate range of the development amount is set in consideration of a setting deviation of a printing system, and is preferably set to 150 to 250 $\mu$g/cm$^2$.

In the appropriate range of the development amount, ink having a predetermined b/p ratio in which a change in the image density is smallest is an optimized ink, and a selection procedure of such ink is called ink optimization.

In selecting the b/p ratio of ink, if the b/p ratio is excessively decreased, which means that the amount of pigment is larger than that of binder, a fixation characteristic of the toner onto paper is deteriorated.

Figure 4:
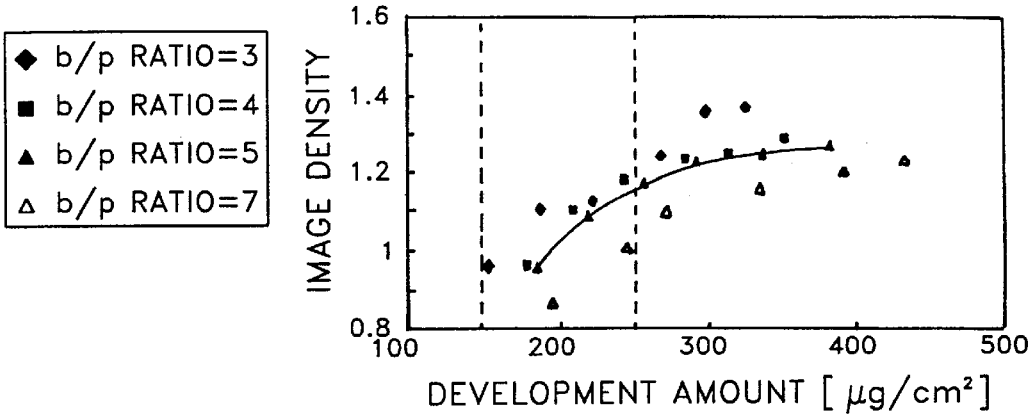
FIG. 4 is a graph illustrating the relationship between the development amount and the image density depending on the change in the ratio of binder to pigment in yellow (Y) toner.
Figure 5:
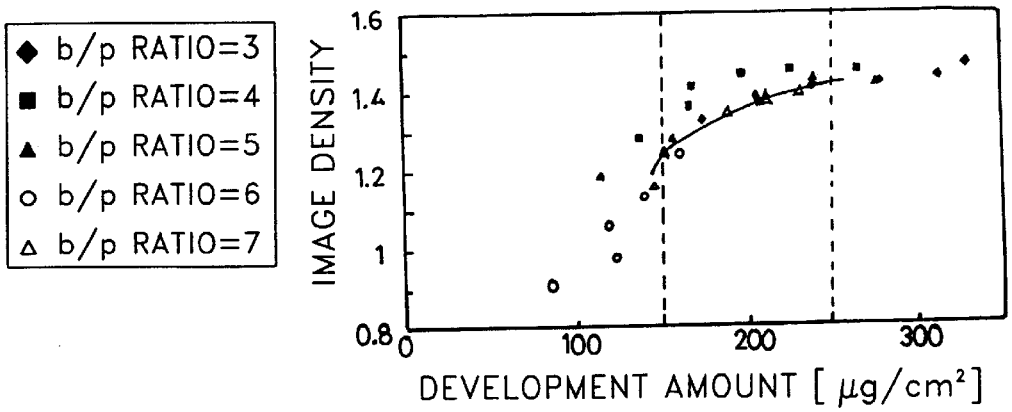
FIG. 5 is a graph illustrating the relationship between the development amount and the image density depending on the change in the ratio of binder to pigment in magenta (M) toner.
Figure 6:
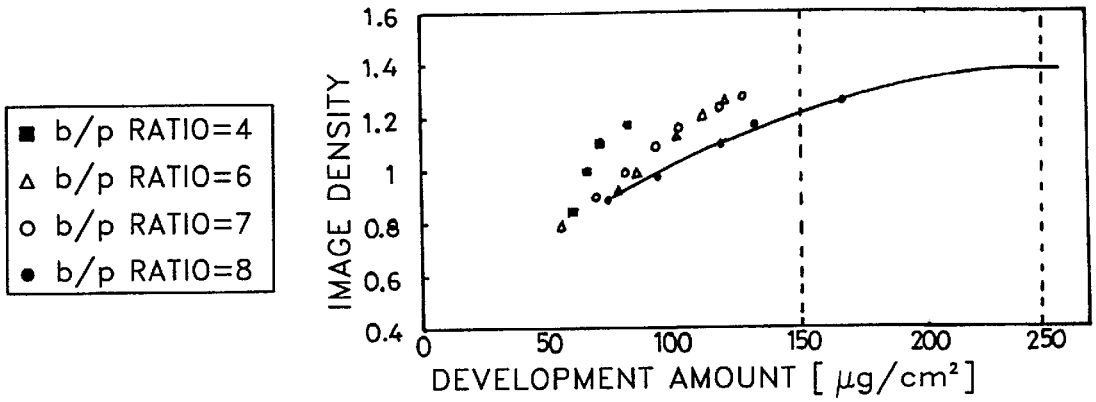
FIG. 6 is a graph illustrating the relationship between the development amount and the image density depending on the change in the ratio of binder to pigment in cyan (C) toner.

The b/p ratio of ink is selected with reference to the graphs of FIGS. 4 thru 6, showing the relationship between the development amount, depending on a change in the b/p ratio, and the image density.

Referring to FIGS. 4 thru 6, if the development amount of each colored ink is greater than or equal to a predetermined value, a change in the image density decreases. Also, as the b/p ratio increases, the image density at the same level of the development amount is reduced. Here, black ink is excluded since it does not contribute to coloring.

Referring to FIG. 4 for the case of yellow (Y) ink, when the b/p ratio is 5, the image density is maintained at 0.9 to 1.15, and thus in the appropriate range of development amount exhibiting the smallest deviation in image density.

Referring to FIG. 5 for the case of magenta (M) ink, when the b/p ratio is 7, the image density is maintained at 1.2 to 1.4, and thus in the appropriate range of development amount exhibiting the smallest deviation in image density.

Referring to FIG. 6 for the case of cyan (C) ink, when the b/p ratio is 8, the image density is maintained at 1.2 to 1.4, and thus in the appropriate range of development amount exhibiting the smallest deviation in image density.

Considering these results and the setting deviation, it is preferred that the respective b/p ratios of Y, M and C inks be set as defined in the following expressions:

$$b/p_{yellow(Y)}=5\pm1;$$

$$b/p_{magenta(M)}=7\pm1;$$

and $$b/p_{cyan(C)}=8\pm1.$$

In the case of selecting pigments as in the Comparative Example shown in Table 1, the optimal image density will now be described. Also, based on optimal image density thus selected, color reproduction characteristics of primary yellow, magenta and cyan colors and overlapping mixed colors of over-toned red, green and blue colors will be described.

An optimal image density is defined as the image density in which the reproducible color gamut is largest. Here, the term "reproducible color gamut" refers to a hexagonal area formed by six colors of Y, M, C, R, G and B in an L*a*b* color coordinate system, that is, a two-dimensional color gamut.

Figure 7:
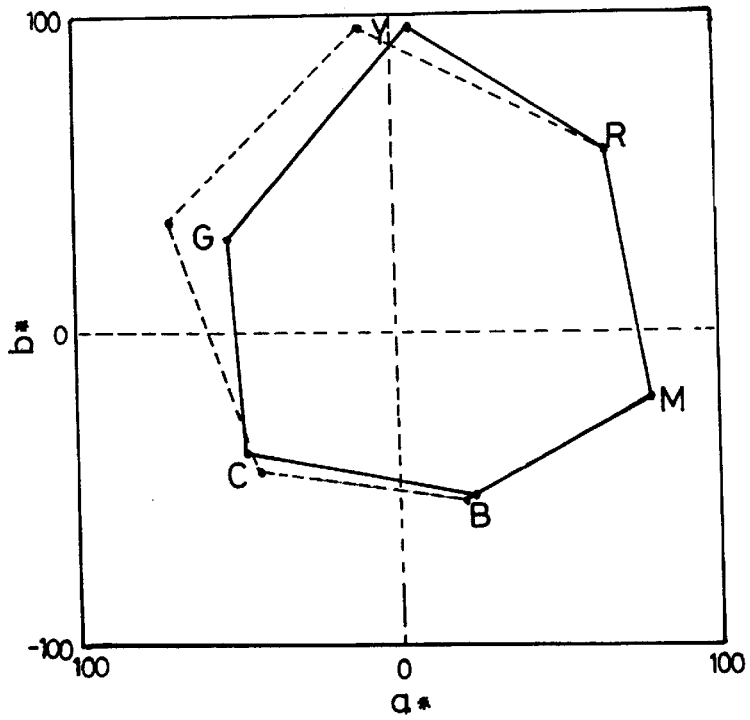
FIG. 7 is a graph illustrating a two-dimensional color gamut when ink satisfying the conditions listed in Table 1 is employed in the color printing system shown in FIG. 1.

The optimal image density is determined by selecting, from given combinations of ink sets, an image density at which the largest two-dimensional color gamut is obtained when varying the image densities of the respective colors by using the inks listed in Table 1 and applying different development voltages to the respective development devices. FIG. 7 shows a two-dimensional color gamut at the image density of the ink sets listed in Table 1.

Table 4 summarizes the area of the two-dimensional color gamut of a color printer, as shown in FIG. 7, and image densities.

TABLE 4

| | Comparative Example |
|---|---|
| Image density | |
| Y | 1.14 |
| M | 1.25 |
| C | 1.38 |
| Two-dimensional color gamut [a*b*] | 13748 |

As described above, and as shown in Table 4, when compared to the two-dimensional color gamut of a desired image density as indicated by a dotted line in FIG. 7, the ink in the Comparative Example has a problem with color reproducibility of green. That is to say, green is a color produced by over-toning of cyan ink over yellow ink. The cyan ink in the Comparative Example is inclined to green, compared to other colored inks. From this, it is understood that deterioration in the color reproducibility in a green area is mainly caused by red components densely contained in the yellow ink.

In order to improve the deterioration in the color reproducibility of green, the pigment of the yellow ink is selected as follows. Specifically, the yellow ink inclined to red is made to be slanted to green, thereby improving the color reproducibility of the green area. To this end, in the Y ink, the ratios of PY138 to PY83 are made to be 10:0, 9:1 and 8:2. In this case, two-dimensional color gamuts for 6 colors in the L*a*b* color coordinate system for the respective ratios are shown in FIG. 8.

Figure 8:
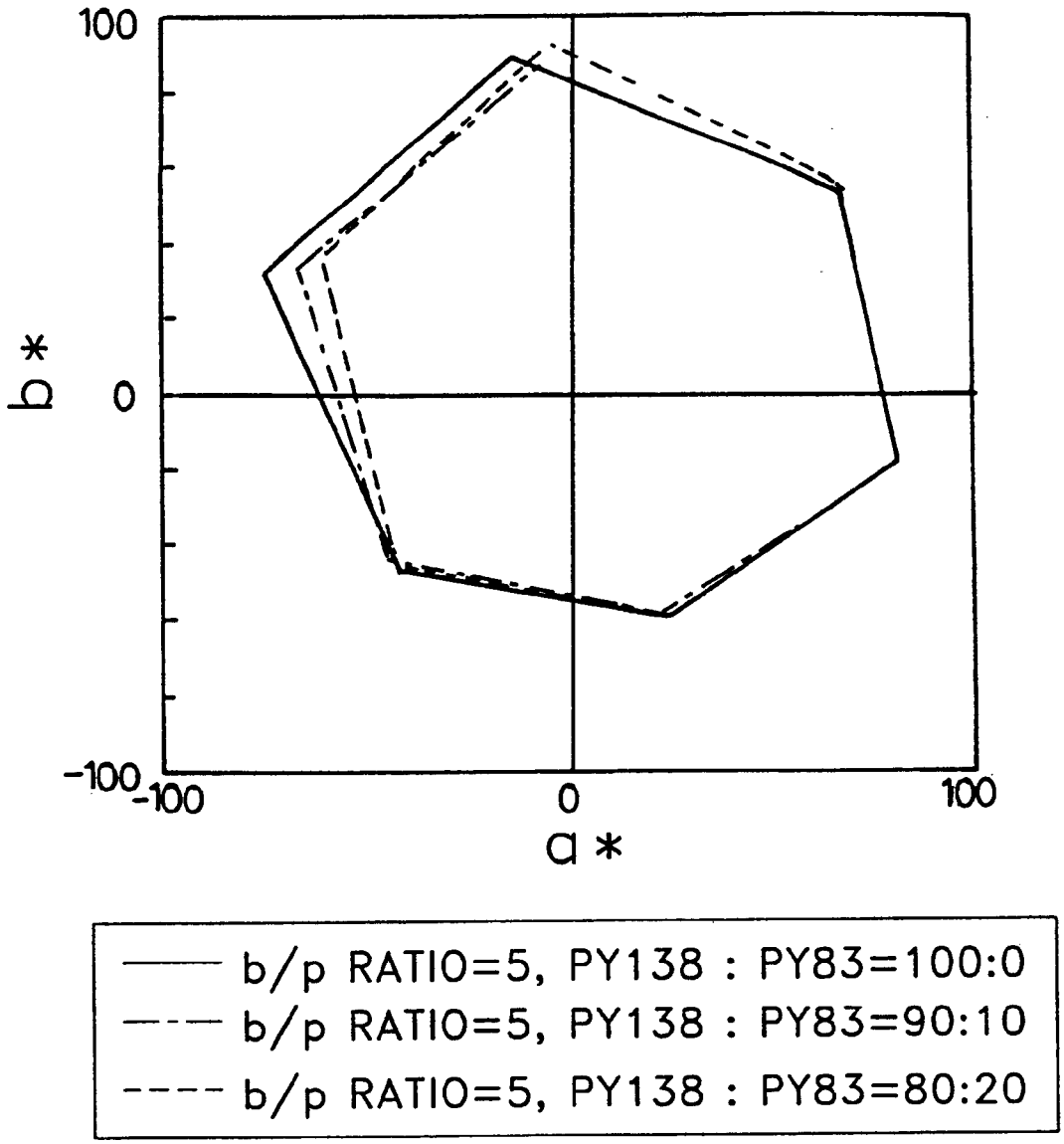
FIG. 8 is a graph illustrating a two-dimensional color gamut for 6 colors in an L*a*b* coordinate system in the cases where the ratios of Pigment Yellow (PY) 138 to Pigment Yellow (PY) 83 in Y ink are 10:0, 9:1 and 8:2, respectively.

Referring to FIG. 8, as the pigment of the Y ink moves toward the green area, the color reproducibility of the green area is distinctly improved. Also, the area of the color gamut exceeds 15500. On the basis of this result, the pigment of the Y ink is selected as 100% of PY138. In this case, the ranges of the image densities of Y, M and C are 0.70 to 0.75, 1.32 to 1.37 and 1.32 to 1.37, respectively.

Figure 9:
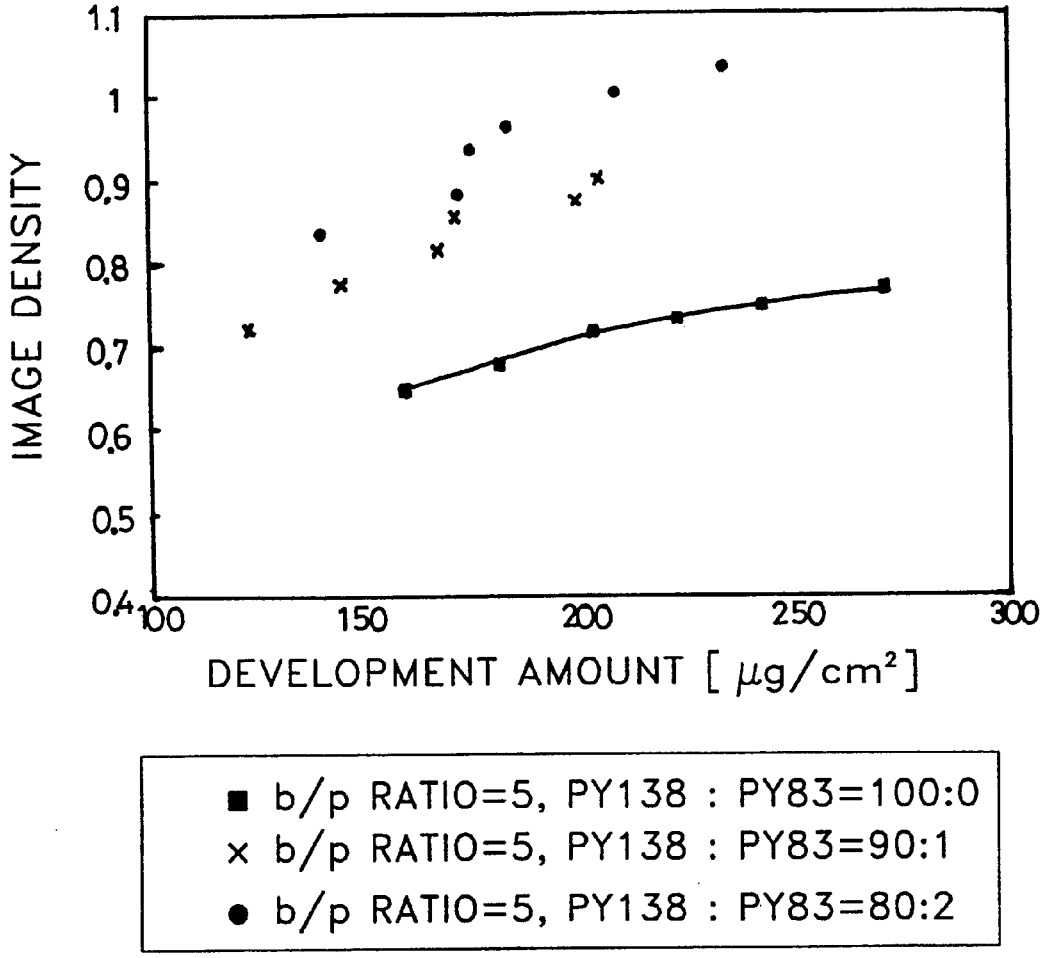
FIG. 9 is a graph illustrating the relationship between the image density and the development amount depending on the blending ratio of pigments in Y ink.

FIG. 9 is a graph showing the relationship between image density and development amount depending on a blending ratio of Y ink pigments. Referring to FIG. 9, the pigment identified in the Color Index as being 100% PY138 exhibits the smallest change in the target image density. Thus, it is preferred to select a Y ink pigment having a b/p ratio of about 5, and identified in the Color Index as PY138.

As described above, the ink for a liquid electrophotographic color printing system according to the present invention can enhance resolution by decreasing the sizes of toner particles, as compared to the case of a dry printing system. Also, in order to minimize the variation in the image density depending on a change in the development amount due to wash-off, the blending ratio of binder to pigment is particularly selected for each colored ink, thereby preventing the image density from being lowered due to wash-off.

Further, the Y ink is particularly identified in the Color Index, thereby obtaining a stable over-toned color for green represented by blending primary colors, and attaining a wide color reproducible gamut.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An ink for a liquid electrophotographic color printing system, comprising:

a plurality of toners for yellow (Y), magenta (M) and cyan (C), each toner being provided in a respective one of a plurality of developing devices, and each toner having a pigment (p) for forming an image having a predetermined color, a binder (b) for binding the pigment on printing paper, a charge controller for imparting electrical properties on the toners, and a stabilizer; and a carrier for transferring the toners from the developing devices to a photoreceptor belt during development;

wherein an image density of the magenta (M) toner is in the range of 1.32 to 1.37.

2. The ink according to claim 1, wherein the pigment for the yellow (Y) toner is made of a material identified in a Color Index as Pigment Yellow (PY) 138.

3. The ink according to claim 1, wherein said carrier is a liquid oil selected from the class consisting of a branched paraffinic solvent blend and an aliphatic hydrocarbon solvent blend.

4. The ink according to claim 1, wherein an image density of the yellow (Y) toner is in the range of 0.70 to 0.75.

5. The ink according to claim 4, wherein the pigment for the yellow (Y) toner is made of a material identified in a Color Index as Pigment Yellow (PY) 138.

6. The ink according to claim 1, wherein the blending ratio (b/p) of the binder (b) to the pigment (p) of said each toner for yellow (Y), magenta (M) and cyan (C), respectively, satisfies the following expressions:

$$b/p_{yellow(Y)}=5\pm1;$$

$$b/p_{magenta(M)}=7\pm1;$$

and $$b/p_{cyan(C)}=8\pm1.$$

7. An ink for a liquid electrophotographic color printing system, comprising:

a plurality of toners for yellow (Y), magenta (M) and cyan (C), each toner being provided in a respective one of a plurality of developing devices, and each toner having a pigment (p) for forming an image having a predetermined color, a binder (b) for binding the pigment on printing paper, a charge controller for imparting electrical properties on the toners, and a stabilizer; and a carrier for transferring the toners from the developing devices to a photoreceptor belt during development;

wherein an image density of the cyan (C) toner is in the range of 1.32 to 1.37.

8. The ink according to claim 7, wherein the pigment for the yellow (Y) toner is made of a material identified in a Color Index as Pigment Yellow (PY) 138.

9. The ink according to claim 7, wherein an image density of the magenta (M) toner is in the range of 1.32 to 1.37.

10. The ink according to claim 7, wherein said carrier is a liquid oil selected from the class consisting of a branched paraffinic solvent blend and an aliphatic hydrocarbon solvent blend.

11. The ink according to claim 7, wherein an image density of the yellow (Y) toner is in the range of 0.70 to 0.75.

12. The ink according to claim 11, wherein an image density of the magenta (M) toner is in the range of 1.32 to 1.37.

13. The ink according to claim 7, wherein the blending ratio (b/p) of the binder (b) to the pigment (p) of said each toner for yellow (Y), magenta (M) and cyan (C), respectively, satisfies the following expressions:

$$b/p_{yellow(Y)}=5\pm1;$$

$$b/p_{magenta(M)}=7\pm1;$$

and $$b/p_{cyan(C)}=8\pm1.$$

14. An ink for a liquid electrophotographic color printing system, comprising:

a plurality of toners for yellow (Y), magenta (M) and cyan (C), each toner having a pigment (p) for forming an image having a predetermined color and a binder (b) for binding the pigment on printing paper; and a carrier for transferring the toners from development devices to a photoreceptor belt during development;

wherein an image density of the magenta (M) toner is in the range of 1.32 to 1.37.

15. The ink according to claim 14, wherein an image density of the yellow (Y) toner is in the range of 0.70 to 0.75.

16. The ink according to claim 15, wherein the pigment for the yellow (Y) toner is made of a material identified in a Color Index as Pigment Yellow (PY) 138.

17. The ink according to claim 14, wherein the pigment for the yellow (Y) toner is made of a material identified in a Color Index as Pigment Yellow (PY) 138.

18. The ink according to claim 14, further comprising a charge controller for imparting electrical properties on the toners, and a stabilizer.

19. The ink according to claim 14, wherein said carrier is a liquid oil selected from the class consisting of a branched paraffinic solvent blend and an aliphatic hydrocarbon solvent blend.

20. An ink for a liquid electrophotographic color printing system, comprising:

a plurality of toners for yellow (Y), magenta (M) and cyan (C), each toner having a pigment (p) for forming an image having a predetermined color and a binder (b) for binding the pigment on printing paper; and a carrier for transferring the toners from development devices to a photoreceptor belt during development;

wherein an image density of the cyan (C) toner is in the range of 1.32 to 1.37.

21. The ink according to claim 20, wherein the pigment for the yellow (Y) toner is made of a material identified in a Color Index as Pigment Yellow (PY) 138.

22. The ink according to claim 20, wherein an image density of the magenta (M) toner is in the range of 1.32 to 1.37.

23. The ink according to claim 20, wherein an image density of the yellow (Y) toner is in the range of 0.70 to 0.75.

24. The ink according to claim 23, wherein an image density of the magenta (M) toner is in the range of 1.32 to 1.37.

25. The ink according to claim 20, further comprising a charge controller for imparting electrical properties on the toners, and a stabilizer.

26. An ink for a liquid electrophotographic color printing system, comprising:

a plurality of toners for yellow (Y), magenta (M) and cyan (C), each toner being provided in a respective one of a plurality of developing devices, and each toner having a pigment (p) for forming an image having a predetermined color, a binder (b) for binding the pigment on printing paper, a charge controller for imparting electrical properties on the toners, and a stabilizer; and a carrier for transferring the toners from the developing devices to a photoreceptor belt during development;

wherein an image density of the yellow (Y) toner is in the range of 0.70 to 0.75.

27. An ink for a liquid electrophotographic color printing system, comprising:

a plurality of toners for yellow (Y), magenta (M) and cyan (C), each toner having a pigment (p) for forming an image having a predetermined color and a binder (b) for binding the pigment on printing paper; and a carrier for transferring the toners from development devices to a photoreceptor belt during development;

wherein an image density of the yellow (Y) toner is in the range of 0.70 to 0.75.

* * * * *